US011340030B2

(12) United States Patent
O'Clair

(10) Patent No.: US 11,340,030 B2
(45) Date of Patent: May 24, 2022

(54) PISTOL, EJECTOR AND TAKEDOWN LEVER

(71) Applicant: Smith & Wesson Inc., Springfield, MA (US)

(72) Inventor: Sean O'Clair, Blandford, MA (US)

(73) Assignee: Smith & Wesson Inc., Springfield, MA (US)

( * ) Notice: Subject to any disclaimer, the term of this patent is extended or adjusted under 35 U.S.C. 154(b) by 175 days.

(21) Appl. No.: 16/993,630

(22) Filed: Aug. 14, 2020

(65) Prior Publication Data

US 2020/0370850 A1 Nov. 26, 2020

Related U.S. Application Data

(62) Division of application No. 16/567,078, filed on Sep. 11, 2019, now abandoned.

(60) Provisional application No. 62/730,027, filed on Sep. 12, 2018.

(51) Int. Cl.

| | |
|---|---|
| ***F41A 3/66*** | (2006.01) |
| ***F41A 17/36*** | (2006.01) |
| ***F41C 3/00*** | (2006.01) |

(52) U.S. Cl.

CPC ..... *F41A 3/66* (2013.01); *F41A 17/36* (2013.01); *F41C 3/00* (2013.01)

(58) Field of Classification Search

CPC .. F41A 3/16; F41A 15/16; F41A 15/14; F41A 15/12; F41A 3/66; F41A 17/36

See application file for complete search history.

(56) References Cited

U.S. PATENT DOCUMENTS

| | | | | |
|---|---|---|---|---|
| 2,982,044 | A * | 5/1961 | Sefried, II | F41A 15/06 42/47 |
| 4,627,184 | A * | 12/1986 | Ruger | F41A 11/00 89/196 |
| 4,676,017 | A * | 6/1987 | Hurlemann | F41A 15/14 42/25 |
| 5,317,949 | A * | 6/1994 | Sugg | F41A 19/47 89/27.11 |
| 2010/0236121 | A1* | 9/2010 | McGarry | F41A 17/56 42/69.02 |
| 2011/0219656 | A1* | 9/2011 | McGarry | F41C 23/14 42/70.06 |
| 2012/0167426 | A1* | 7/2012 | O'Clair | F41A 11/02 42/2 |
| 2013/0133237 | A1* | 5/2013 | Domian | F41A 17/36 42/70.02 |
| 2015/0323267 | A1* | 11/2015 | Donnelly | F41A 3/54 89/139 |
| 2019/0033028 | A1* | 1/2019 | Folk | F41A 19/10 |

* cited by examiner

*Primary Examiner* — Joshua E Freeman

(74) *Attorney, Agent, or Firm* — John A. Chionchio, Esq.; Ballard Spahr LLP

(57) ABSTRACT

A semiautomatic pistol has a takedown lever which also acts as an ejector. The takedown lever includes an ejector head and a finger. The finger is engageable with a sear when the takedown lever is rotated by depressing the ejector head through the ejection port when the slide is out of battery. This rotates the sear so that the slide may be removed by sliding it toward the muzzle end of the pistol.

10 Claims, 3 Drawing Sheets

PISTOL, EJECTOR AND TAKEDOWN LEVER

CROSS REFERENCE TO RELATED APPLICATIONS

This application is a divisional of U.S. patent application Ser. No. 16/567,078, filed Sep. 11, 2019, which application is based upon and claims benefit of priority to U.S. Provisional Application No. 62/730,027, filed Sep. 12, 2018, both applications being hereby incorporated by reference herein.

FIELD OF THE INVENTION

This invention concerns takedown levers for semiautomatic pistols.

BACKGROUND

Small pistols, for example, those designed for concealed carry, have less room for internal components than full sized pistols. In view of the limited space available, it would be advantageous if one or more of the internal components each performed multiple functions.

SUMMARY

The invention concerns a takedown lever for use in a semiautomatic pistol. In an example embodiment the takedown lever comprises a body defining a fulcrum for pivotably mounting the takedown lever on the pistol. An ejector head extends from the body and is positioned on a first side of the fulcrum. The ejector head defines an impact surface for deflecting shell casings. A finger extends from the body and is positioned on a second side of the fulcrum opposite to the first side. The finger is engageable with a sear upon rotation of the body about the fulcrum.

An example embodiment further comprises a first recess positioned in the body. The first recess is adapted to receive a detent for holding the body in a first angular position relative to the fulcrum. Further by way of example, a second recess is positioned in the body in spaced apart relation to the first recess. The second recess is adapted to receive the detent for holding the body in a second angular position relative to the fulcrum.

The invention also encompasses a semiautomatic pistol. In one example the pistol comprises a frame. A slide is movably mounted on the frame. A sear is movably mounted on the frame. A takedown lever is pivotably mounted on the frame. By way of example the takedown lever comprises a body defining a fulcrum about which the body rotates. An ejector head extends from the body and is positioned on a first side of the fulcrum. The ejector head defines an impact surface for deflecting shell casings. a finger extends from the body and is positioned on a second side of the fulcrum opposite to the first side. The finger is directly engageable with the sear upon rotation of the body about the fulcrum.

In an example pistol embodiment according to the invention the sear may comprise a lever pivotable about an axis and may have an action surface positioned on a first side of the axis. The finger is directly engageable with the action surface of the sear upon rotation of the body about the fulcrum.

Further by way of example a striker may be mounted within the slide. In an example embodiment the striker has a spur extending therefrom. An engagement surface is positioned on the sear on a second side of the axis opposite to the first side. The engagement surface is engageable with the spur.

An example pistol embodiment may further comprise a detent mounted on the frame. A spring acts between the frame and the detent for biasing the detent toward the body. A first recess is positioned in the body. The first recess is positioned to engage the detent when the body is positioned such that the ejector head is positioned to deflect the shell casings. Further by way of example, a second recess may be positioned in the body in spaced apart relation to the first recess. The second recess is positioned to engage the detent when the body is positioned with the finger engaging the action surface of the sear. In an example embodiment the detent comprises a plunger engaged with the spring.

The invention further encompasses a method for field stripping a pistol. An example method comprises:

- pulling a slide out of battery thereby exposing a takedown lever comprising an ejector head and a finger;
- rotating the takedown lever about a fulcrum by pressing the ejector head to move the finger into direct engagement with a sear, the finger thereby rotating the sear;
- with the sear rotated, moving the slide toward a muzzle end of the pistol until the slide disengages from the frame.

Further by way of example, the takedown lever may be rotated from a first position, wherein the ejector head is aligned with a line of motion of the slide, to a second position, wherein the ejector head is oriented transversely to the line of motion of the slide.

Another example embodiment comprises holding the takedown lever in the first position by engaging a first recess in the takedown lever with a detent, and holding the takedown lever in the second position by engaging a second recess in the takedown lever with the detent.

DETAILED DESCRIPTION

Figure 1:
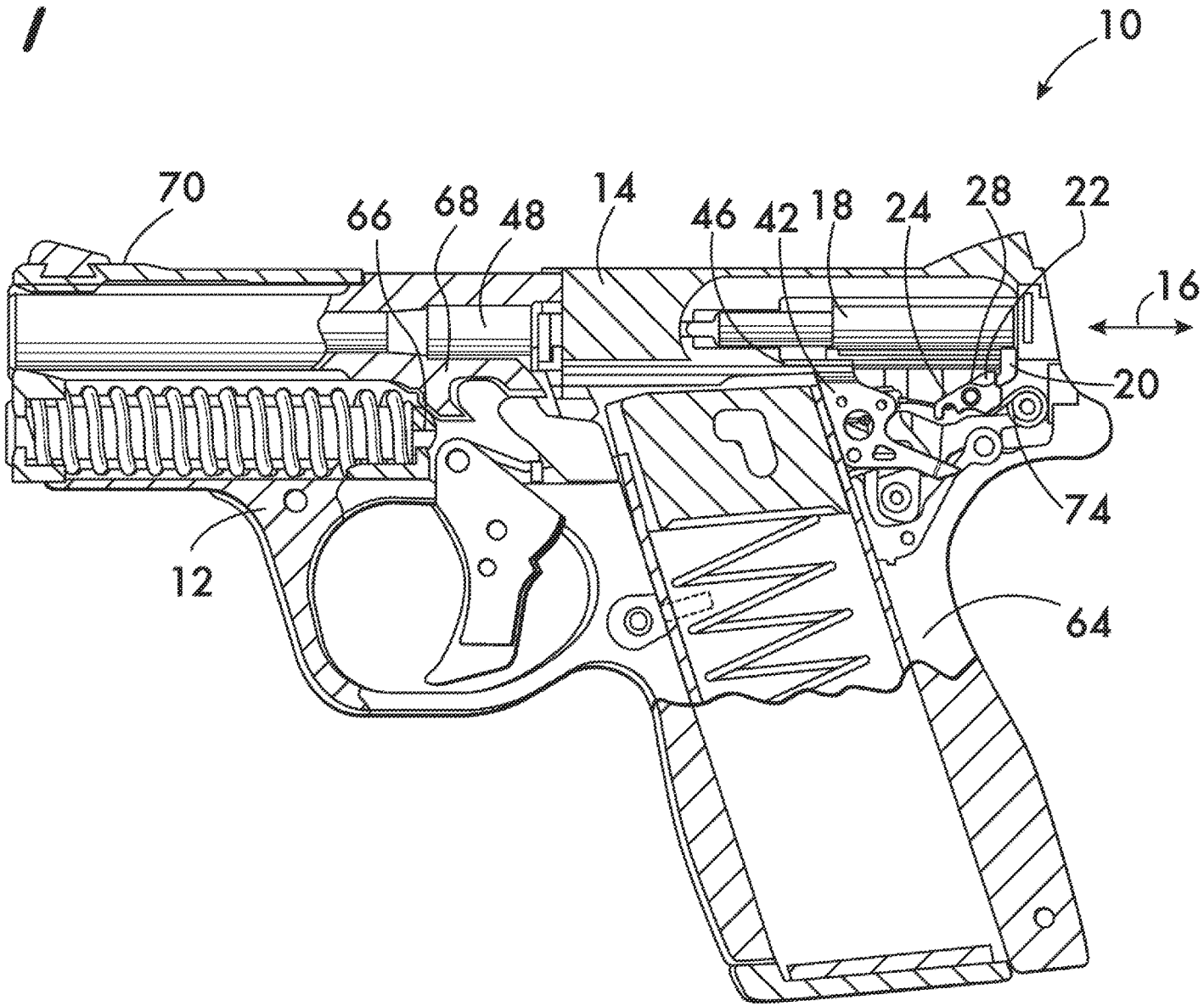
FIG. 1 is a sectional side view of an example pistol according to the invention.
Figure 2:
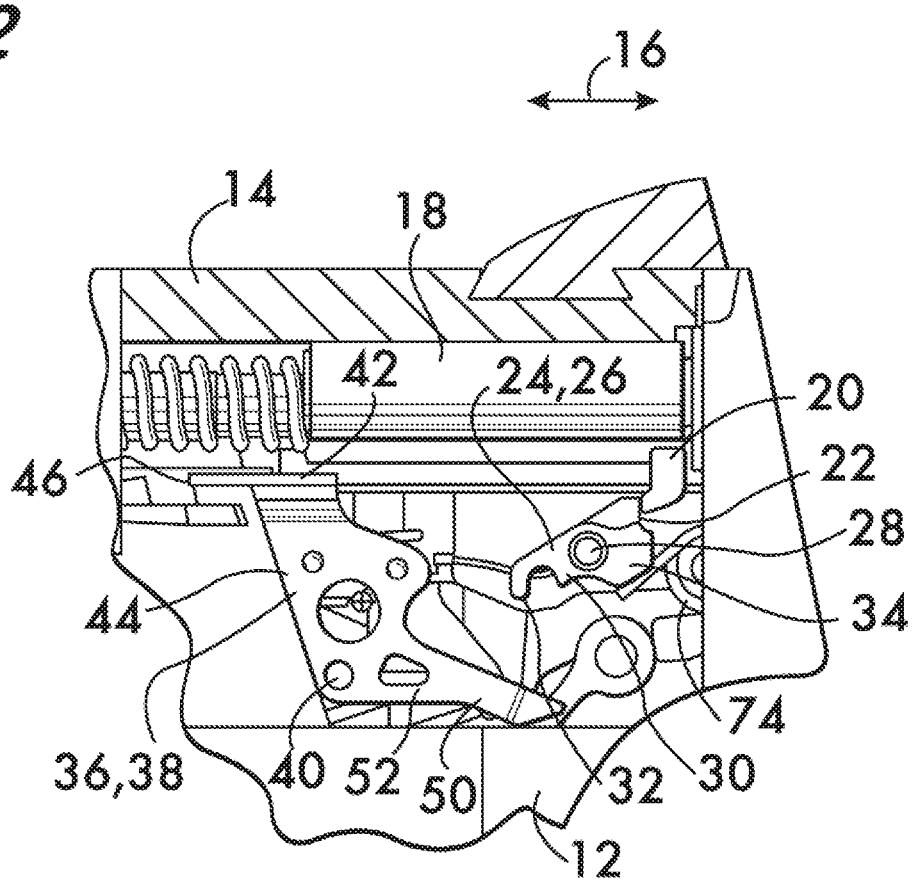
FIG. 2 is a cut-away side view of a portion of the pistol shown in FIG. 1.

FIG. 1 shows an example semi-automatic pistol 10 according to the invention. Pistol 10 comprises a frame 12 on which a slide 14 is mounted and movable along a line of motion 16 (compare FIGS. 1 and 4). As shown in FIG. 2, a striker 18 is mounted within the slide 14, it being understood that the use of a striker is by way of example only, and that other firing mechanisms are also feasible. A spur 20 extends from the striker 18. The spur 20 is engageable with an engagement surface 22 of a sear 24. Sear 24 comprises a lever 26 pivotably mounted on frame 12 for rotation about an axis 28. An action surface 32 is positioned on a first side 30 of the axis 28, and the engagement surface 22 is positioned on a second side 34 of the axis 28 opposite the first side 30.

Figure 3:
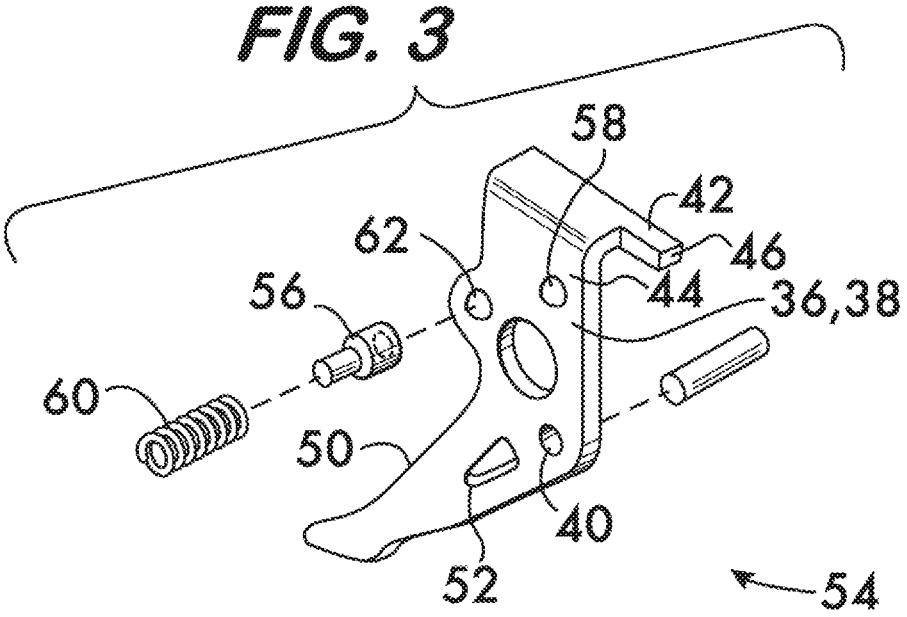
FIG. 3 is an isometric view of an example ejector and takedown lever according to the invention.
Figure 4:
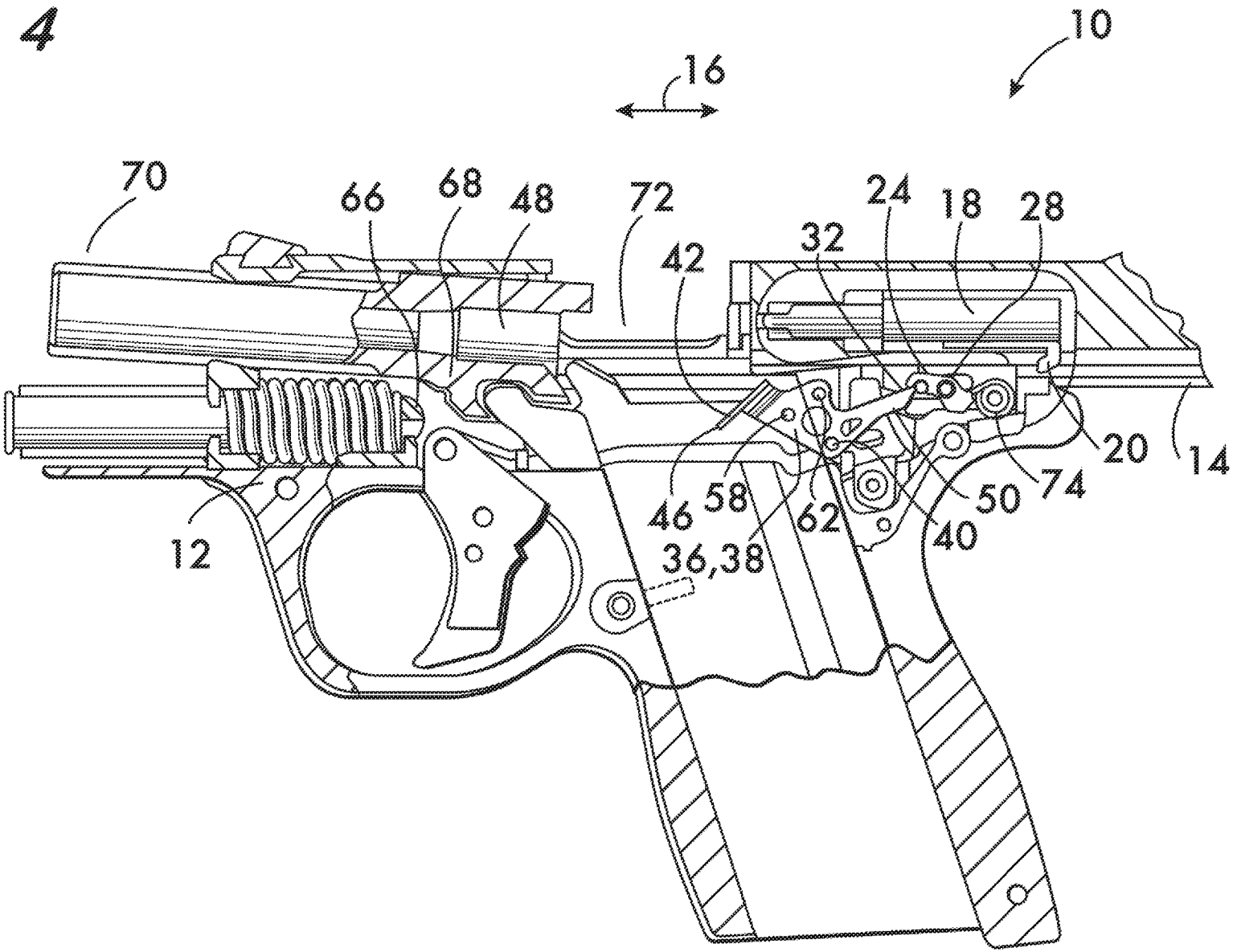
FIG. 4 is a sectional side view of the pistol shown in FIG. 1 with the slide out of battery.

As shown in FIGS. 2 and 3, a takedown lever 36 is pivotably mounted on the frame 12. Takedown lever 36 comprises a body 38 which defines a fulcrum 40 about which the takedown lever rotates. An ejector head 42 extends from body 38 and is positioned on a first side 44 of the fulcrum 40. Ejector head 42 defines an impact surface 46 for deflecting shell casings extracted from the barrel chamber 48 (see FIG. 1) as the slide 12 moves out of battery (see FIG. 4). A finger 50 also extends from body 38 and is positioned on a second side 52 of the fulcrum 40. As shown in FIGS. 2 and 4, the finger 50 is engageable with the action surface 32 of the sear 24 upon rotation of body 38 about its fulcrum 40.

As shown in FIGS. 2, 3 and 4, the takedown lever 36 may be held in one of at least two angular positions (shown in FIGS. 2 and 4) relatively to the fulcrum 40 by a detent 54. As shown in FIG. 3, detent 54 in this example comprises a plunger 56 movably mounted on frame 12 proximate to the body 38. Body 38 has at least a first recess 58 which is positioned to receive the plunger and thus engage the detent 54 to hold the takedown lever 36 in the position shown in FIGS. 1 and 2, where the ejector head 42 is positioned so that the impact surface 46 will deflect shell casings that are extracted and ejected when the slide 14 moves out of battery. In this example this first position of the takedown lever 36 is oriented such that the ejector head 42 aligns with the line of motion 16 of the slide. As shown in FIG. 3, a spring 60 acts between the plunger 56 and the frame 12 to bias the plunger toward the body 38 and into engagement with the first recess 58. In this example a second recess 62 is positioned in body 38 in spaced relation to the first recess 58. The second recess 62 is position so as to engage the plunger 56 when the body 38 is rotated into the second angular position, shown in FIG. 4, wherein the finger 50 engages the action surface 32 of the sear 24 and rotates the sear about its axis 28 so that it will not engage the spur 20 of the striker 18. Engagement between the plunger 56 and the second recess 62 holds the body 38 in the second angular position which allows the pistol 10 to be field stripped as described below.

Using a takedown lever according to the invention allows a pistol to be field stripped according to the following example method. With the slide 14 in battery (FIG. 1), the magazine 64 is removed and any live round in chamber 48 is cleared by pulling the slide 14 out of battery to extract and eject the live round. Note that the ejector head 42 is in position to deflect the live round. With the pistol 10 now unloaded the disassembly cam 66 within the frame 12 is rotated so that it will not block the barrel's locking cam 68. As shown in FIGS. 1 and 2, motion of the slide 14 along line of motion 16 toward the muzzle end 70 of pistol 10 is now prevented only by the engagement of the striker spur 20 with the engagement surface 22 of the sear 24. As shown in FIG. 4, the slide 14 is moved out of battery to expose the ejector head 42 through the ejection port 72 in the slide. The ejector head 42 is depressed, either with a tool or manually, with sufficient force to disengage the plunger 56 from the first recess 58 in body 38 and thereby rotate the body so that the finger 50 engages the action surface 32 and rotates the sear 24 about its axis 28. Note that the sear 24 is biased by a torsion spring 74 so that in the absence of other forces the sear will engage the spur 20, thereby necessitating use of the takedown lever 36 to rotate the sear out of the way. The body 38 is advantageously rotated to the point where the plunger 56 engages the second recess 62, which holds the takedown lever 36 and the sear 24 in the positions shown in FIG. 4. With the sear 24 rotated to a position where it will not engage the spur 20 the slide 14 may be moved toward the muzzle end 70 of the pistol 10 and removed from the frame 12.

Takedown levers according to the invention which combine two or more functions are expected to improve the performance, reliability and cost of semiautomatic pistols by reducing the number of parts as well as the space required on the frame for the various components, allowing pistols to be made smaller for advantage in concealed carry.

What is claimed is:

1. A semiautomatic pistol, said pistol comprising:
- a frame;
- a slide movably mounted on said frame;
- a sear movably mounted on said frame;
- a takedown lever pivotably mounted on said frame, said takedown lever comprising:
- a body defining a fulcrum about which said body rotates;
- an ejector head extending from said body and positioned on a first side of said fulcrum, said ejector head defining an impact surface for deflecting shell casings;
- a finger extending from said body and positioned on a second side of said fulcrum opposite to said first side, said finger directly engaging said sear upon rotation of said body about said fulcrum.

2. The pistol according to claim 1, wherein said sear comprises a lever pivotable about an axis and having an action surface positioned on a first side of said axis, said finger directly engaging said action surface of said sear upon rotation of said body about said fulcrum.

3. The pistol according to claim 2, further comprising:
- a striker mounted within said slide, said striker having a spur extending therefrom;
- an engagement surface positioned on said sear on a second side of said axis opposite to said first side, said engagement surface being engageable with said spur.

4. The pistol according to claim 1, further comprising:
- a detent mounted on said frame;
- a spring acting between said frame and said detent for biasing said detent toward said body;
- a first recess positioned in said body, said first recess being positioned to engage said detent when said body is positioned such that said ejector head is positioned to deflect said shell casings.

5. The pistol according to claim 4, further comprising a second recess positioned in said body in spaced apart relation to said first recess, said second recess being positioned to engage said detent when said body is positioned with said finger engaging said action surface of said sear.

6. The pistol according to claim 4, wherein said detent comprises a plunger engaged with said spring.

7. A method for field stripping a pistol, said method comprising:
- pulling a slide out of battery thereby exposing a takedown lever comprising an ejector head and a finger;
- rotating said takedown lever about a fulcrum by pressing said ejector head to move said finger into direct engagement with a sear, said finger thereby rotating said sear;
- with said sear rotated, moving said slide toward a muzzle end of said pistol until said slide disengages from said frame.

8. The method according to claim 7, wherein said takedown lever is rotated from a first position wherein said ejector head is aligned with a line of motion of said slide to a second position wherein said ejector head is oriented transversely to said line of motion of said slide.

9. The method according to claim 8, further comprising holding said takedown lever in said first position by engaging a first recess in said takedown lever with a detent.

10. The method according to claim 9, further comprising holding said takedown lever in said second position by engaging a second recess in said takedown lever with said detent.

* * * * *